US008485082B1

(12) United States Patent
Masaki

(10) Patent No.: US 8,485,082 B1
(45) Date of Patent: Jul. 16, 2013

(54) FIREARM BARREL

(76) Inventor: Edward Masaki, Honolulu, HI (US)

( * ) Notice: Subject to any disclaimer, the term of this patent is extended or adjusted under 35 U.S.C. 154(b) by 0 days.

(21) Appl. No.: 12/496,625

(22) Filed: Jul. 30, 2009

Related U.S. Application Data

(60) Provisional application No. 61/077,471, filed on Jul. 1, 2008.

(51) Int. Cl.
*F41A 21/36* (2006.01)

(52) U.S. Cl.
USPC ..... 89/14.3; 89/14.2; 89/14.4; 89/198; 181/223

(58) Field of Classification Search
USPC ..... 89/14.2, 14.3, 14.4, 198; 42/1.06, 42/79; 181/223
See application file for complete search history.

(56) References Cited

U.S. PATENT DOCUMENTS

| | | | | |
|---|---|---|---|---|
| 819,834 | A * | 5/1906 | Zalinski | 89/7 |
| 3,628,415 | A * | 12/1971 | McElroy | 89/14.05 |
| 3,665,804 | A | 5/1972 | Rohr | |
| 3,858,481 | A * | 1/1975 | Elliott | 89/14.3 |
| 4,446,771 | A * | 5/1984 | Anthony et al. | 89/14.6 |
| 4,545,285 | A | 10/1985 | McLain | |
| 4,942,801 | A | 7/1990 | Schuemann | |
| 5,010,676 | A * | 4/1991 | Kennedy | 42/71.01 |
| 5,123,328 | A | 6/1992 | Schuemann | |
| 5,309,814 | A * | 5/1994 | Mossberg | 89/14.6 |
| 5,423,242 | A | 6/1995 | Schuemann | |
| 5,666,756 | A * | 9/1997 | Moller | 42/77 |
| 6,595,099 | B1 | 7/2003 | Olson | |
| 6,769,346 | B2 | 8/2004 | Rosenthal | |
| 7,059,235 | B2 | 6/2006 | Hanslick | |

* cited by examiner

*Primary Examiner* — Michael David

(74) *Attorney, Agent, or Firm* — Conrad R. Leikauf, Esq.

(57) ABSTRACT

A firearm barrel that reduces muzzle climb and recoil by tapping a portion of the discharge products near the breech and venting them toward the muzzle end of a firearm. Some discharge products have also have an upward component to reduce muzzle climb, some have a downward or sideways component to lessen the effect of the upwardly directed discharge products on a top mounted accessory such as a telescopic sight.

5 Claims, 3 Drawing Sheets

FIREARM BARREL

BACKGROUND OF THE INVENTION

One of the effects of recoil is muzzle climb. Muzzle climb is a factor in timed rapid fire. Higher rise increases the time required to realign the sights with the target and also causes inaccuracy by moving the firearm off target during the bullet travel down the barrel.

There are many devices that seek to reduce recoil. Common names include muzzle brakes, recoil compensators, suppressors, and linear compensators. Many devices function by trapping the propellant gases at the muzzle, or beyond with an attachment, and guiding the gases upward in an attempt to reduce the effect of muzzle climb. Some also vent to the side with a backward angle.

One technique takes gases from near the chamber-barrel rifling interface, carries them separate from the rifled portion of the barrel to the muzzle, then vents them directly upward. One technique involves directly porting a shotgun barrel near the muzzle. Some of these foul after relatively few rounds have been fired and must be cleaned to restore functionality. Some direct gases back toward the shooter or adjacent people. Many allow the firearm to move significantly off target, requiring significant movement of the firearm to re-acquire the target. There is a need for a recoil reduction system which reduces muzzle climb so that accuracy is improved and that subsequent shots may be fired more quickly.

Muzzle brakes and compensators work at the muzzle end of a firearm. Some such as U.S. Pat. No. 4,545,285 by McLain direct gases upward and rearward, towards a shooter. Others, such as U.S. Pat. No. 7,059,235 by Hanslick direct gases upward and forward, away from a shooter.

A variation on this technique is taught in U.S. Pat. No. 6,595,099 by Olsen et al. This teaching reveals trapping the propellant gases at the muzzle, or beyond with an attachment, and guiding the gases through multiports upward in an attempt to reduce the effect of muzzle climb. Some of the multiports also vent to the side with a backward angle to reduce recoil.

Another technique ports the barrel back away from the muzzle. This is shown in U.S. Pat. No. 4,942,801, 5,123,328 & 5,423,242 by Schuemann These teach that the center of a plurality of ports is approximately midway between the muzzle and the chamber and located along the top of the barrel, pointed upwardly.

A variation on this technique is taught in U.S. Pat. No. 6,769,346 by Rosenthal. This teaches taking gases from near the bottom of the barrel and porting them through a passage to vent them in an upward direction.

The farther from the chamber that the gasses are tapped, the longer the firearm has had to recoil and have muzzle climb. Tapping the gasses just before they leave the muzzle only operates as the bullet is almost leaving the barrel and after muzzle rise and recoil has begun. Techniques that vent gasses upward from the top of the barrel make using a top mounted scope difficult or impossible. Rear venting techniques can cause gasses to interfere with the shooter or adjacent people. What is needed is a firearm that begins to address recoil and muzzle climb very soon after the bullet has begun traveling, vents the gasses away from the shooter and those nearby, does not require frequent cleaning, and allows for a top mounted scope to be installed.

SUMMARY OF THE INVENTION

This disclosure teaches an improved firearm barrel that solves or reduces one or more problems with the prior art. It is applicable to blow-back and gas operated firearms.

A feature of this disclosure is venting some discharge products from the breech end of the barrel towards the muzzle through vent passageways. A portion of the stream of venting discharge products are directed forward and up to reduce muzzle climb while reducing the impact on the shooter and adjacent people compared to some muzzle brakes. A portion of another stream of venting discharge products is directed forward and down or forward and to the side to limit fouling on an optional scope sight by modifying the direction of upward dispersing discharge products.

The embodiment shown is based on an M1911A1 type semi-automatic pistol in 9 mm or .45 caliber.

This type of pistol normally toggles the barrel. In this embodiment, the barrel was modified so that it does not toggle and the locking lugs normally located on the top of the barrel have been removed. To make up for the removal of the lugs, additional locking pins may be substituted.

Due to the wide variety of firearms and cartridges, a definitive disclosure on all possible variations is not feasible. However, one skilled in the art can adapt these teachings for other firearms while being within the bounds of this disclosure.

DESCRIPTION

Figure 1:
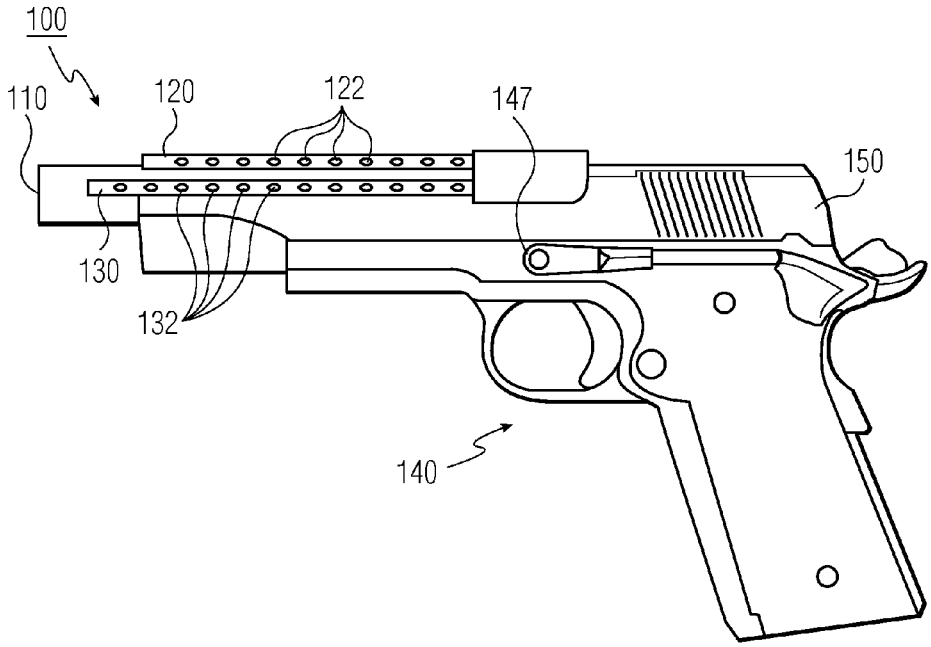
FIG. 1 is a side view of a firearm modified according to the present disclosure.

Referring to FIG. 1, firearm 100 has a barrel 110, a frame 140 and a slide 150. Slide lock 147 is secured, referring to FIG. 2, by slide lock receiver 213. Referring to FIG. 1, barrel 110 is comprised of upper vent passageway 120 and lower vent passageway 130. Upper vent passageway 120 is comprised of upper atmospheric vent 122. Lower vent passageway 130 is comprised of lower atmospheric vent 132. Upper atmospheric vent 122 and lower atmospheric vent 132 are each approximately 3⁄32 inches in diameter and are separated approximately ¼ inch along their respective vent passageways.

Lower vent passageway 130 is long enough to contain sufficient lower atmospheric vents 132 to reduce muzzle climb and exhaust the discharge products past a top mounted accessory such as a telescopic sight, in this embodiment is approximately 4½ inches long and is positioned high enough to clear slide 150. Upper vent passageway 120 is long enough to provide sufficient upper atmospheric vents 122 to protect a top mounted accessory such as a telescopic sight from the upward discharge products from lower atmospheric vents 132, in this embodiment approximately 3¾ inches long, and is positioned above lower vent passageway 130 and low enough so that it does not interfere with an top mounted optional accessory such as a telescopic sight.

Upper vent passageway 120 and lower vent passageway 130 must be made of a material able to withstand the heat and pressure of the discharge products. In this embodiment they are made of stainless steel but one skilled in the art can choose another suitable material. Upper vent passageway 120 and lower vent passageway 130 are, in inner diameter, approximately 2/32 inches.

Figure 2:
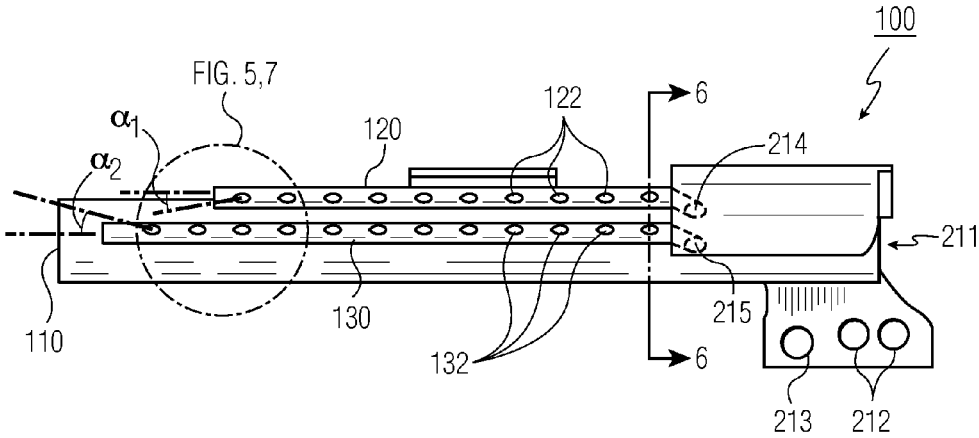
FIG. 2 is a side view of a firearm barrel modified according to the present disclosure.
Figure 3:
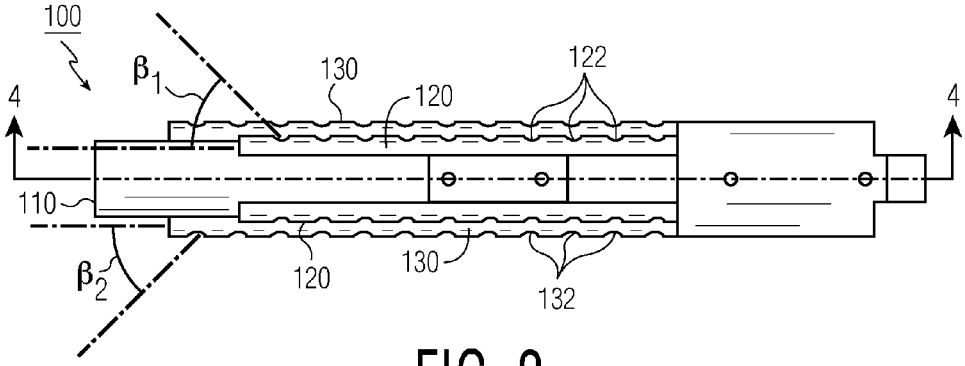
FIG. 3 is a top view of a firearm barrel modified according to the present disclosure.
Figure 4:
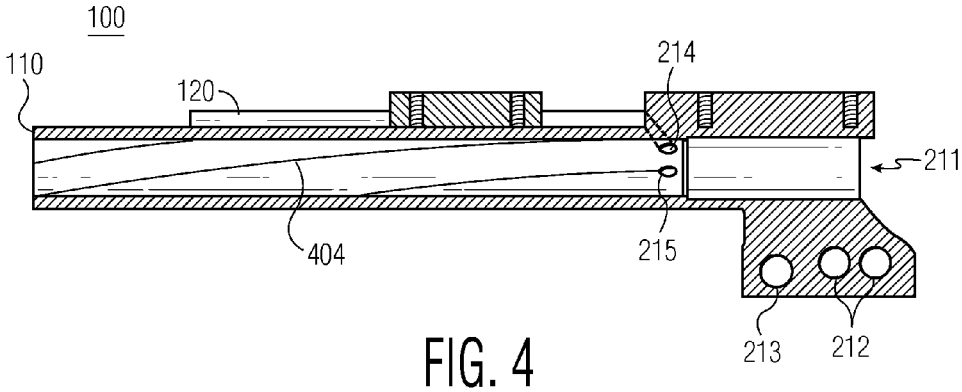
FIG. 4 is a section view along the long axis of the modified barrel of FIG. 3.

Referring to FIGS. 2 and 4, barrel 110 of firearm 100 is further comprised of a chamber 211, pin receiver 212, upper breech end vent 214 and lower breech end vent 215. Referring to FIG. 4, barrel 110 has a rifled portion, 404. Upper breech end vent 214 and lower breech end vent 215 are located in the portion that has rifling 404, past the muzzle end of chamber 211, and vent to upper vent passageway 120 and lower vent passageway 130, respectively. Upper breech end vent 214 takes a portion of the discharge products to vent passageway 120. Lower breech end vent 215 takes a portion of the discharge products to lower vent passageway 130. Referring to FIGS. 2 & 3, the sampled discharge products vent to the atmosphere through upper atmospheric vent 122 at a downward angle $\alpha_1$, at a forward angle $\alpha_2$ and, referring to FIG. 6, through the muzzle end of upper vent passageway 120. Referring to FIGS. 2 & 3, the sampled discharge products also vent to the atmosphere through lower atmospheric vent 132 at a upward angle $\beta_1$, at a forward angle $\beta_2$ and, referring to FIG. 6, through the muzzle end of lower vent passageway 130. Referring to FIGS. 2 & 4, barrel 110 has pin receiver 212 to receive pins used to hold barrel 110 to frame 140.

Upper breech end vent 214 and lower breech end vent 215 are each about 2/32 in diameter.

Lower atmospheric vents 132 guide the discharge products forward toward the muzzle end and upward. Upper atmospheric vents 122 guide the discharge products forward toward the muzzle end and, in this embodiment, to the side. The discharge products from upper atmospheric vents 122 interact and influence the direction of the discharge products from lower atmospheric vents 132.

Upward angle $\alpha_2$ can range from 10° to approximately 40°, and in this embodiment is approximately 15°. Forward angle $\beta_2$ can range from 10° to approximately 40°, and in this embodiment is approximately 15°.

Downward angle $\alpha_1$ is designed to deflect vented discharge products exiting lower breech end vent 215 via lower atmospheric vent 132 from a top mounted accessory such as a telescopic sight, and can range from 0° to approximately 40° and in this embodiment is approximately 0° (zero). Forward angle $\beta_1$ can range from approximately 10° to approximately 40° and in this embodiment is approximately 15°.

Forward angle $\beta_1$ and forward angle $\beta_2$ are designed to vent discharge products away from the shooter and adjacent shooters.

Upper breech end vent 214 and lower breech end vent 215 are located inside the rifled portion of barrel 110 very close to the breech end and in this embodiment is about 1/32 of an inch from chamber 211. If upper breech end vent 214 and lower breech end vent 215 are placed too close to chamber 211, a cartridge case can be fire formed into the vents making extraction unreliable. The farther upper breech end vent 214 and lower breech end vent 215 are placed from the breech end of barrel 110, the greater the reduction of muzzle climb due to the longer time lag before the venting begins reducing the recoil.

Figure 5:
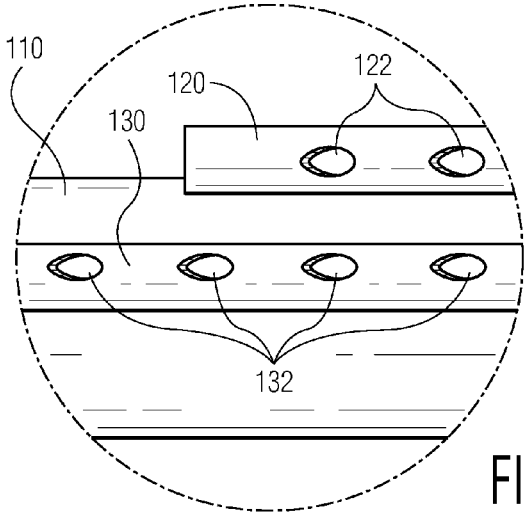
FIG. 5 is an enlarged view of a portion of the modified barrel of FIG. 2, showing the atmospheric vents.

Referring to FIG. 5, an enlargement of a portion of FIG. 2, upper atmospheric vent 122 is situated at approximately the midline of vent passageway 120. Lower atmospheric vent 132 is situated above the midline of vent passageway 130.

Figure 6:
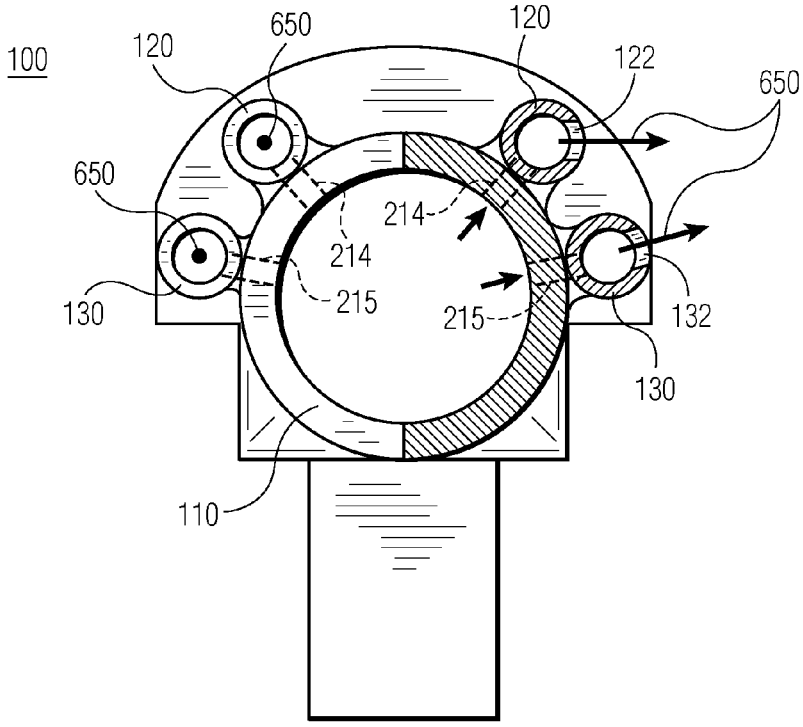
FIG. 6 is a partially sectioned view of a modified barrel from the muzzle end.

Referring to FIG. 6, a cutaway view of FIG. 2, upper breech end vent 214 is connected to upper vent passageway 120 of barrel 110. Lower breech end vent 215 is connected to lower vent passageway 130 of barrel 110. Discharge products 650 are exhausted at an angle of 0° to the horizontal through upper atmospheric vent 122 and at an upward angle of approximately 15° through lower atmospheric vent 132. Discharge products 650 are also vented from the muzzle end of upper vent passageway 120 and lower vent passageway 130.

Figure 7:
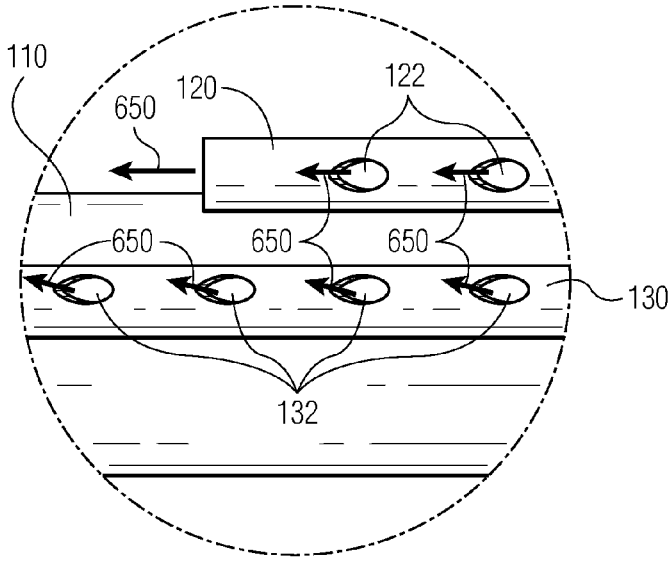
FIG. 7 is an additional view of FIG. 5 showing the angles of the vent discharge products.

Referring to FIG. 7, an additional view of the enlargement shown in FIG. 5, discharge products 650 exit the upper through vent passageway 120 and upper atmospheric vent 122. Similarly, discharge products 650 exit through vent passageway 130 to lower atmospheric vent 132.

Referring to FIGS. 6 & 7, upper vent passageway 120 and lower vent passageway 130 are not capped. This reduces fouling.

The term discharge products as used throughout this disclosure is meant to be widely interpreted and comprises all of the gases, particulates, including burnt and unburnt powder, metal, and other matter that is produced by the discharge of the cartridge and are available at the breech end vents.

One skilled in the firearm making art can produce the barrel in various ways such as using a thick enough barrel and cutting the passageways and breech end vents prior to attaching the barrel to a chamber, or by adding external passageways.

Due to the wide variety of firearms and cartridges, a definitive disclosure on all possible variations is not feasible. However, one skilled in the art can adapt these teachings for other firearms while being within the bounds of this disclosure.

The following should be considered a starting point for one skilled in the art. Best results were obtained using a Douglas™ barrel. Loads for .45 caliber are 4.6 grains of BULLSEYE™ with a 200 grain lead semi-wadcutter or 4 grains of Bullseye with a 180 to 185 grain lead semi-wadcutter, both bullets 0.452 in diameter. Load for 9 mm is 4.8 grains of VIHTAVUORI® N340 powder and a 115 or 124 grain jacketed hollow point.

This disclosure teaches the venting of discharge products from the breech end of the barrel. Vent passageways from the breech end vents are used to carry and disperse the discharge products. The dispersing discharge products are directed upward to assist in controlling muzzle rise, to the side to limit fouling on an optional scope sight by modifying the direction of upward dispersing discharge products, and forward to reduce the impact on adjacent shooters.

The invention claimed is:

1. A firearm barrel comprised of:

(a) a plurality of breech end vents near the breech end of the barrel;

(b) a plurality of vent passageways located to receive discharge products from the barrel through the breech end vents;

(c) the vent passageways comprised of a plurality of upper atmospheric vents and lower atmospheric vents, both upper atmospheric vents and lower atmospheric vents having a forward angle of approximately 10° to approximately 40° with the upper atmospheric vents also having a downward angle from approximately 0° to approximately 40° and the lower atmospheric vents also having an upward angle from approximately 10° to approximately 40°.

2. A firearm barrel as in claim 1 where the upper atmospheric vents have a forward angle of approximately 15°.

3. A firearm barrel as in claim 1 where the lower atmospheric vents have a forward angle of approximately 15°.

4. A firearm barrel as in claim 1 where the upper atmospheric vents have a downward angle of approximately 0°.

5. A firearm barrel as in claim 1 where the lower atmospheric vents have an upward angle of approximately 15°.

* * * * *